United States Patent [19]

Snooks, Jr. et al.

[11] Patent Number: 4,472,481

[45] Date of Patent: Sep. 18, 1984

[54] CARPET FIBER BLENDS

[75] Inventors: Rupert J. Snooks, Jr., Gulf Breeze; William D. Weatherford; James R. Nicholson, both of Pensacola, all of Fla.

[73] Assignee: Monsanto Company, St. Louis, Mo.

[21] Appl. No.: 552,529

[22] Filed: Nov. 16, 1983

[51] Int. Cl.[3] ..... D02G 3/00

[52] U.S. Cl. ..... 428/362; 57/248; 57/253; 57/254; 428/359; 428/369; 428/397

[58] Field of Search ..... 428/359, 362, 369, 397, 428/357; 57/246, 248, 252, 253, 254, 255

[56] References Cited

U.S. PATENT DOCUMENTS

| | | | |
|---|---|---|---|
| 1,884,007 | 3/1971 | Cook | 57/140 |
| 2,271,184 | 1/1942 | Dreyfus | 28/1 |
| 3,220,173 | 11/1965 | Pitzl | 57/248 |
| 3,293,110 | 12/1966 | Stine et al. | 161/169 |
| 3,508,390 | 4/1970 | Bagnall et al. | 57/248 X |
| 3,604,197 | 9/1971 | Sekiguchi et al. | 57/140 BY |
| 3,608,297 | 9/1971 | Cobb | 57/253 |
| 3,802,177 | 4/1974 | Sekiguchi et al. | 57/140 BY |
| 3,994,122 | 11/1976 | Shah | 57/140 BY |
| 4,001,369 | 1/1977 | Shah | 57/248 |
| 4,263,777 | 4/1981 | Wada et al. | 57/227 |

*Primary Examiner*—Lorraine T. Kendell
*Attorney, Agent, or Firm*—John W. Whisler

[57] ABSTRACT

A blend of crimped trilobal carpet fibers, each having a modification ratio and denier within specified ranges are provided. Carpets made from the fiber blend have an excellent overall balance of firmness, cover and luster.

11 Claims, No Drawings

CARPET FIBER BLENDS

BACKGROUND OF THE INVENTION

A. Field of the Invention

This invention relates to a blend of fibers and yarns therefrom. The yarns are useful as carpet yarns and provide carpets having an excellent overall balance of firmness, cover and luster. The term fibers as used herein means fibers in the form of either continuous filaments or staple. The term yarn as used herein means a continuous strand of fibers and includes tow. The term blend means any combination of two or more fibers. The term carpet firmness as used herein means the resistance of the carpet pile to the downward force of an object and relates to the springiness or resilience of the carpet pile. The term carpet cover as used herein means the ability of the carpet fibers of the pile to cover the backing and give the carpet body or a full appearance. The term carpet luster as used herein means the quality of shining or sparkling of the carpet fibers with reflected light.

B. Description of the Prior Art

In the production of fiber for use in carpets, it is desirable to produce fiber that will provide carpets having a pleasing appearance with respect to cover, firmness, and luster. One method of increasing carpet cover for the same carpet weight is to use trilobal fibers having a high modification ratio. However, increasing the modification ratio results in a reduction in both carpet firmness and carpet luster. A low level of carpet luster is generally considered undesirable with respect to customer preference. U.S. Pat. No. 3,994,122 describes a blend of crimped fibers for use in carpet. The blend comprises two components or groups of trilobal fibers of the same denier, one group having a modification ratio between 1.6 and 1.9 and the other group having a modification ratio between 2.2 and 2.5. While the blend of fibers provides an improved appearance when compared to carpets produced from fibers of either component of the blend, there is still room for further improvements along these lines.

The terms modification ratio (MR) and trilobal fibers as used herein have their usual art recognized meaning, such as defined in U.S. Pat. No. 2,939,201.

SUMMARY OF THE INVENTION

In accordance with the present invention a blend of crimped polyamide fibers and yarns therefrom is provided from which carpets can be made having a superior balance of properties with respect to luster, firmness and cover. The blend comprises (a) 70–90% by weight of crimped trilobal polyamide fibers each having a modification ratio ranging from 3.0 to 3.4 and a denier ranging from 16 to 24 and (b) 30–10% by weight of crimped trilobal polyamide fibers each having a modification ratio ranging from 1.7 to 2.4 and a denier ranging from 6 to 12. The blend of fibers may be in the form of a continuous filament yarn, a collection of staple fibers (e.g. a bale) or a staple yarn made from such a collection of staple fibers. As used herein the term "yarn" includes a tow of continuous filaments.

DETAILED DESCRIPTION OF THE PREFERRED EMBODIMENTS OF THE INVENTION

The fiber blends of the present invention comprise a first component (Component A) consisting of crimped polyamide fibers each having a trilobal cross-section, a modification ratio (MR) ranging from 3.0 to 3.4 and a denier ranging from 16 to 20, and a second component (Component B) consisting of crimped polyamide fibers each having a trilobal cross-section, a modification ratio ranging from 1.7 to 2.4 and a denier ranging from 6 to 12.

In general, increasing either the crimp, in terms of crimps per inch (cpi), or the modification ratio or the denier of trilobal polyamide fibers, results in a change in the cover, firmness and luster of carpets made therefrom. The relationship of each of these fiber variables on carpet cover, firmness and luster is shown in the following table.

| Variable | Bulk Firmness | Cover | Luster |
|---|---|---|---|
| CPI ↑[1] | ↑ | ↑ | ↓[2] |
| MR ↑ | ↓ | ↑ | ↓ |
| DPF ↑ | ↑ | ↓ | ↑ |

[1] ↑ = increases
[2] ↓ = decreases

The fiber blends of the present invention offer an optimum balance of cover, firmness and luster in carpets.

It is preferred that the two major components of the fiber blend be of approximately the same crimp level. For carpet fibers the crimp level will generally be in the range of from 8 to 15 crimps per inch (20.4 to 38.1 cpcm).

It will be understood that small amounts (e.g., less than 5% by weight) of other fibers may be present in the blends such as, for example, conductive fibers of the type disclosed in U.S. Pat. No. 3,969,559 to Boe.

The fibers of the blends may contain conventional additives incorporated therein such as delustrants (e.g., $TiO_2$), heat and light stabilizers, dye agents, and the like. Normally, such additives are added to the polyamide-forming monomers or molten polyamide prior to fiber formation.

Polyamides useful in preparing the fiber blends of the invention and which are of major commercial importance are nylon 66 (polyhexamethylene adipamide) and nylon 6 (poly-ε-caprolac tam). Other polyamides include the common nylons such as nylon 11, nylon 610 and copolymers of nylon 66 and nylon 6, such as, nylon 66/6 and nylon 66/6TA where 6TA is hexamethylene terephthalamide units, i.e.,

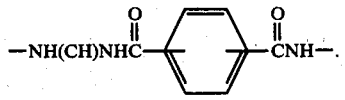

A fiber blend in the form of continuous filament yarn may be conveniently prepared by forming the blend during melt spinning. This can be accomplished by using a single spinneret adapted to spin Component A and Component B filaments in the appropriate ratio which are then converged to form yarn or by using separate spinnerets for forming each of the Component filaments and then combining the Component filaments in the appropriate ratio to form yarn. The yarn may be draw-textured to provide a crimped yarn or a plurality of such yarns may be combined to form a tow. The tow may be used to form staple fibers. Normally, the tow will be drawn, crimped, cut to a desired length and baled. Carpet staple fibers conventionally range in length from 6 to 8 inches (15.2 to 20.3 cm). The bale may be further blended with other bales of staple fibers formed from the same or corresponding tow. Alternatively, bales of Component A staple fibers may be blended with bales of Component B staple fibers in an appropriate ratio to provide 70–90% by weight of Components A fibers and 10–30% of Component B fibers. The staple fibers are then carded, drafted and spun on a conventional ring spinning frame to form a staple yarn.

The following examples are given to further illustrate the invention.

EXAMPLE 1

Fiber-forming grade polyhexamethylene adipamide (nylon 66) was prepared and melt extruded to form trilobal filaments that were quenched and combined into tow. The tow was drawn, crimped and cut into staple having an average length of 7.5 inches (19 cm) and 10.5 cpi (26.5 cpcm). Staple A, prepared in this manner, had a denier per fiber (dpf) of 16 and an MR of 3.2. Staple B was prepared in the same manner, except in this instance the staple had a dpf of 12, and MR of 1.8. Staple A and Staple B were blended to provide a blend consisting of 80% by weight of Staple A and 20% by weight of Staple B. The blended staple fibers were carded, drafted and spun into a 3.5 cotton count (cc) yarns having 5 tpi (1.97 t/cm) of twist in the "Z" direction. Two of these yarns were plied with 4 tpi (1.57 t/cm) in the "S" direction to provide a carpet yarn. The yarn was heatset using conventional conditions and made into a saxony style carpet having 27.0 oz/yd$^2$ (915.8 g/m$^2$) pile weight with a pile height of ⅝ inch (1.6 cm) using a 3/16 inch (0.5 cm) gauge and a polypropylene primary backing. For purposes of comparison two identical carpets (controls) were made, one from Staple A and the other from Staple B. The carpets were dyed to a gold color, and after a secondary backing was applied, tip sheared and defuzzed. The carpet made from the blend of Staples A and B possessed better overall appearance and aesthetics with respect to luster, firmness and cover than either of the control carpets. All the carpets exhibited good dye characteristics. The carpets were tested to determine their floor performance. This was accomplished by subjecting each carpet to 15,000 traffics, where a traffic occurs each time a person walks across the carpet. The carpet prepared from the blend of Staple A and B had better appearance retention characteristics than either of the control carpets. All of the carpet performed satisfactorily and no traffic lane was evident on any of the carpets after the test.

EXAMPLE 2

Carpet yarns were prepared in the manner described in Example 1, except in one instance Staple B consisted of trilobal fibers each having a dpf of 10 and an MR of 1.8 and in another instance Staple B consisted of trilobal fibers each having a dpf of 8 and an MR of 1.8. In all other respects the blend of fibers and the yarns made therefrom were the same. Each of the yarns were made into carpet identical in construction to that described in Example 1. Again, the fiber blends provided carpets superior in appearance and aestheics to control carpets and giving good floor performance and appearance retention characteristics after 15,000 traffics.

In related experiments carpets were made from blends of trilobal nylon 66 staple fibers in which the weight ratio of Staple A to B were outside the range specified for the fiber blends of the present invention, for example 67/33, or the deniers and/or MR's were outside the range those specified for the fiber blend components of the present invention. In each instance the resulting carpets were inferior with respect to a blance of luster, firmness and cover when compared to corresponding carpets made from fiber blends of the present invention.

EXAMPLE 3

In this example fiber was prepared using a spinneret designed to permit simultaneous melt spinning of Component A filaments and Component B filaments in a weight ratio of 80/20, respectively. The filaments were combined to form a tow that was processed into staple fibers (Stable A and Staple B) following the procedure described in Example 1. Staple A consisted of trilobal fibers each having a staple length of 7½ inches, a denier of 16 and an MR of 3.2. Staple B consisted of trilobal fibers each having a staple length of 7½ inches, a denier of 12 and an MR of 1.8. The blend of Staple A and Staple B fibers was processed into yarn in the manner described in Example 1 and used in making saxony carpet of the same construction described in Example 1. Also, for purposes of comparison to identical carpets (controls) were made, one from Staple A and the other from Staple B. The resulting carpet had better overall appearance and aesthetics when compared to control carpets.

EXAMPLE 4

In this example a continuous filament nylon 66 yarn was prepared using an 82-hole spinneret designed to permit simultaneous melt spinning of Component A and Component B trilobal filaments. The resulting 4920 denier yarn was quenched and subsequently draw-textured to provide a 1650 denier crimped bulked, continuous filament yarn in which 80% by weight of the filaments (Component A) each had an MR of 3.2 and a denier of 24, and 20% by weight of the filaments (Component B) each had an MR of 1.8 and a denier of 12. The yarn was made into carpet in the manner described in Example 1. The carpet had a good balance of luster, firmness and cover.

We claim:

1. A blend of fibers comprising (a) 70–90% by weight of crimped trilobal polyamide fibers each having a modification ratio ranging from 3.0 to 3.4 and a denier ranging from 16 to 24 and (b) 10–30% by weight of crimped trilobal polyamide fibers each having a modification ratio ranging from 1.7 to 2.4 and a denier ranging from 6 to 12.

2. The blend of claim 1 wherein the blend comprises 80% by weight of (a) and 20% by weight of (b).

3. The blend of claim 2 wherein the modification ratio of (a) is 3.2 and that of (b) is 1.8.

4. The blend of claim 3, wherein the denier of (a) is 16 and that of (b) is 12.

5. The blend of claim 1 wherein said polyamide is nylon 66.

6. The blend of claim 4 wherein said polyamide is nylon 66.

7. The blend of claim 1 wherein said fibers are in the form of yarn.

8. The yarn of claim 7 wherein said fibers are continuous filaments.

9. The yarn of claim 7 wherein said fibers are staple fibers.

10. The blend of claim 1 in the form of a collection of staple fibers.

11. The blend of claim 1 in the form of a bale of staple fibers.

* * * * *